US006503565B1

(12) United States Patent
Hughes et al.

(10) Patent No.: US 6,503,565 B1
(45) Date of Patent: Jan. 7, 2003

(54) METAL TREATMENT WITH ACIDIC, RARE EARTH ION CONTAINING CLEANING SOLUTION

(75) Inventors: Anthony Ewart Hughes, Olinda (AU); Karen Joy Hammon Nelson, Clayton (AU); Russell James Taylor, Balwyn (AU); Bruce Roy William Hinton, Frankston (AU); Mark Julian Henderson, Glenhuntly (AU); Lance Wilson, East Bentleigh (AU); Sally Ann Nugent, Surrey Hills (AU)

(73) Assignee: Commonwealth Scientific and Industrial Research Organisation, Campbell Act (AU)

( * ) Notice: Subject to any disclaimer, the term of this patent is extended or adjusted under 35 U.S.C. 154(b) by 1172 days.

(21) Appl. No.: 08/939,702

(22) Filed: Sep. 29, 1997

Related U.S. Application Data

(63) Continuation of application No. 08/615,269, filed as application No. PCT/AU94/00539 on Sep. 12, 1994, now abandoned.

(30) Foreign Application Priority Data

Sep. 13, 1993 (AU) ..... PM-1182

(51) Int. Cl.[7] ..... B05D 3/00
(52) U.S. Cl. ..... 427/299; 427/319
(58) Field of Search ..... 427/299, 319; 428/650; 106/1.05, 1.25

(56) References Cited

U.S. PATENT DOCUMENTS

| | | | | |
|---|---|---|---|---|
| 3,969,152 A | 7/1976 | Melotik | ..... | 148/6.15 Z |
| 4,264,278 A | 4/1981 | Weingart | ..... | 416/226 |
| 4,298,404 A | 11/1981 | Greene | ..... | 148/6.14 A |
| 4,310,390 A | 1/1982 | Bradley et al. | ..... | 204/37 R |
| 4,349,392 A | 9/1982 | Huvar | ..... | 148/6.2 |
| 4,359,347 A | 11/1982 | Da Fonte, Jr. | ..... | 148/6.14 R |

(List continued on next page.)

FOREIGN PATENT DOCUMENTS

| | | | | |
|---|---|---|---|---|
| AU | 22855/92 | 9/1992 | ..... | C23C/22/44 |
| EP | 0 331 284 | 9/1989 | ..... | C23C/22/00 |
| EP | 0367504 | 5/1990 | ..... | C23C/22/68 |
| EP | 0 488 430 A2 | 3/1992 | ..... | C23C/22/68 |
| EP | 95 92 1651 | 7/1992 | | |
| EP | 0603 921 A1 | 6/1994 | ..... | C23C/22/10 |
| EP | 0603 921 B1 | 6/1994 | ..... | C23C/22/10 |

(List continued on next page.)

OTHER PUBLICATIONS

139 Galvanotechnik 85 (1994) Juni, No. 6, Saulgau (Wurtt.), DE (Abstract).

R.G. King, "*Surface Treatment and Finishing of Aluminum*", Chapter 6,Pergamon Press, 1988.

D.R. Arnott, N.E. Ryan, B.R.W. Hinton, B.A. Sexton and A.E. Hughes, "*Auger and XPS Studies of Cerium Corrosion Inhibition on 7075 Aluminium Alloy*", Applications of Surface Science 22/23 (1985) 235–251, North–Holland, Amsterdam; Elsevier Science Publishers B.V. (North–Holland Physics Publishing Division).

*Primary Examiner*—Benjamin L. Utech
(74) *Attorney, Agent, or Firm*—McDermott, Will & Emery

(57) ABSTRACT

A metal surface which has been cleaned using an alkaline based solution is treated with an acidic solution which contains rear earth ions to remove any smut which may have been produced during the alkaline cleaning. A coating is formed on the cleaned surface using a different acidic solution containing rare earth cations which have multiple valence states. When the surface is reacted with coating solution, an increase in the pH at the metal surface indirectly results in precipitation of a rare earth metal such as cerium onto the surface. Alternatively, after the removal of the smut, the surface may be coated using a painting technique.

38 Claims, 6 Drawing Sheets

U.S. PATENT DOCUMENTS

| | | | | |
|---|---|---|---|---|
| 4,711,667 | A | 12/1987 | Bibber | 106/14.21 |
| 4,725,375 | A | 2/1988 | Fujii et al. | 252/79.4 |
| 4,755,224 | A | 7/1988 | Bibber | 106/14.21 |
| 4,851,148 | A | 7/1989 | Yamosoe et al. | 252/142 |
| 4,878,963 | A | 11/1989 | Bibber | 148/262 |
| 4,921,552 | A | 5/1990 | Sander et al. | 148/247 |
| 4,988,396 | A | 1/1991 | Bibber | 148/269 |
| 5,030,323 | A | 7/1991 | Awad | 156/665 |
| 5,118,356 | A | 6/1992 | Darmon et al. | 134/3 |
| 5,192,374 | A | 3/1993 | Kindler | 148/272 |
| 5,194,138 | A | 3/1993 | Mansfeld et al. | 205/183 |
| 5,198,141 | A | 3/1993 | Darmon et al. | 252/142 |
| 5,221,371 | A | 6/1993 | Miller | 148/273 |
| 5,356,492 | A | 10/1994 | Miller | 148/273 |
| 5,362,335 | A | 11/1994 | Rungta | 148/272 |
| 5,383,982 | A | 1/1995 | Hauffe et al. | 148/262 |

FOREIGN PATENT DOCUMENTS

| | | | | |
|---|---|---|---|---|
| GB | 1368230 | | 7/1972 | C23G/1/12 |
| GB | 2 059 445 | A | 4/1981 | C23F/7/00 |
| GB | 2 097 024 | A | 10/1982 | C23F/7/00 |
| WO | 88-06639 | | 9/1988 | C23C/22/48 |
| WO | 88/06639 | | 9/1988 | C23C/22/48 |
| WO | 95/00340 | | 10/1994 | C23C/22/53 |
| WO | WO95/08008 | | 3/1995 | C23F/1/20 |
| WO | WO96/11290 | A | 4/1996 | C23C/22/48 |
| WO | WO96/11290 | | 4/1996 | C23C/22/48 |

METAL TREATMENT WITH ACIDIC, RARE EARTH ION CONTAINING CLEANING SOLUTION

This application is a continuation of application Ser. No. 08/615,269 filed May 22, 1996, now abandoned, which is a 371 of PCT/AU94/00539, filed Sep. 12, 1994.

FIELD OF THE INVENTION

This invention relates to a process for treating metal surfaces and a treating solution for use in such a process. The invention also relates to a metal surface treated by the process of the invention. The process is particularly useful for cleaning metal surfaces, such as in a pretreatment of metal surfaces. In such a pretreatment application, the process may provide a uniform and chemically active surface prior to further surface treatment, such as the application of a coating by painting, conversion coating, anodising or plating.

BACKGROUND OF THE INVENTION

In technologies dealing with pretreatment of metal surfaces, a clean uniform metal surface is often crucial in the overall effectiveness of the treatment process. In particular, a uniform, chemically active metal surface is very important for the adherence of an applied coating such as paint, powder coatings, polymer coatings and conversion coatings.

While surface impurities and/or contamination can be successfully removed by mechanical abrasion of the metal, mechanical abrasion is labor intensive and therefore uneconomical. It may also lead to excessive pitting and other damage to the surface. Chemical cleaning is therefore generally favoured.

One common means of chemically cleaning metal surfaces is by treatment with alkaline based solutions. Such solutions dissolve contaminants and impurities such as oxides from the surface of the metal, but may also etch surface oxides and/or metal. The result is often that a smut is left on the surface of the metal which requires further treatment of the metal to remove it. As used herein, the term "smut" is intended to include impurities, oxides and any loosely-bound intermetallic particles which as a result of the alkaline treatment are no longer incorporated into the matrix of the alloy.

Traditionally, removal of smut left after alkaline treatment has been effected by acidic solutions having effective amounts of appropriate additives. These "de-smutting", or "deoxidising", solutions remove smut from the metal surface and preferably etch the metal surface to remove oxide scale in order to leave a substantially homogeneous surface for any subsequent treatment. Many such prior desmutting solutions contain chromium ions. The use of chromium-containing desmutting solutions is particularly prevalent, but not restricted to, the field of metal conversion coatings. The term "conversion coating" is a well known term of the art and refers to the replacement of native oxide on the surface of a metal by a controlled chemical formation of a chemical film. Oxides or phosphates are common conversion coatings. Conversion coatings are used on metals, such as aluminium, steel, zinc, cadmium or magnesium and their alloys, and provide a key for paint adhesion and/or corrosion protection of the substrate metal. Accordingly, conversion coatings find application in such areas as the aerospace, architectural and building industries.

In recent years however it has been recognised that the hexavalent chromium ion, $Cr^{6+}$, is a serious environmental and health hazard. Consequently, strict restrictions have been placed on the quantity of $Cr^{6+}$ used in a number of industrial processes and limitations placed on its release to the environment, leading to costly effluent processing.

There is clearly a need for an alternative metal treating solution which effectively cleans metal surfaces but does not pose the same environmental and health risks of the prior art.

An object of the present invention is therefore to overcome, or at least alleviate, one or more of the difficulties and/or deficiencies related to the prior art.

SUMMARY OF THE INVENTION

Accordingly, the present invention provides a process for cleaning a metal surface including the steps of:

(a) contacting said metal surface with an alkaline cleaning solution in order to remove contaminants such as dirt and grease; and (b) contacting said metal surface with an acidic, rare earth ion containing solution thereby to remove smut formed on said metal surface by step (a).

The present invention also provides an acidic, rare earth ion containing aqueous cleaning solution for use in step (b) of the process defined in the preceding paragraph, said solution including ions of one or more rare earth ions, wherein the pH and concentration of rare earth ions in solution are effective to remove smut from a metal surface previously contacted with an alkaline cleaning solution.

Steps (a) and (b) of the treating process of the present invention may be used as a pretreatment of a metal surface prior to a subsequent finishing treatment such as applying paint or a coating. It is particularly useful as a pretreatment of metal surfaces prior to the application of a conversion coating thereto, such as a rare earth element based conversion coating.

One such conversion coating process has been described in Australian patent specification AU-A-14858/88. The conversion coating process comprises contacting a metal surface with a solution formed by an aqueous acidic solution containing cerium cations and $H_2O_2$ in which some or all of the cerium cations have been oxidised to the +4 valence state. Gaseous evolution in the region of the metal surface causes an increase of the solution pH to a sufficiently high value to precipitate a cerium containing coating on the metal surface.

Accordingly the present invention further provides a process for forming a rare earth element containing coating on the surface of a metal, including the steps of:

(a) contacting said metal surface with an alkaline cleaning solution to remove surface contaminants such as dirt, grease and oxides;

(b) contacting said metal surface with an acidic, rare earth ion containing cleaning solution thereby to remove smut formed on said metal surface during step (a); and (c) contacting the metal surface with an aqueous acidic, rare earth ion containing coating solution including rare earth cations capable of having more than one valence state, resulting in an increase of the pH of the acidic solution in the region of the metal surface to a value sufficient to precipitate one or more compounds of the rare earth element, thereby to cause the compound of the rare earth element to precipitate in a coating on the metal surface.

Pretreatment of the metal surface by steps (a) and (b) of the present invention is found to result in improved corrosion resistance and/or at least similar adhesion characteristics of the subsequently applied coating compared to the properties of a rare earth element based coating applied to a metal surface which was not subjected to any pretreatment or was instead pretreated with a chromate based cleaning solution. Also, the rare earth pretreatment results in a shorter time being subsequently required to deposit the rare earth element-based coating, as compared to other metal pretreatments, such as Cr based deoxidising solutions. Moreover, the absence of $Cr^{6+}$ in the solutions used significantly reduces the risk to health and the environment.

The step of contacting with an alkaline cleaning solution may be preceded by a degreasing step in which the metal surface is contacted with a degreasing composition, such as trichloroethane or a solution available under the trade name of BRULIN, which is an aqueous degreasing solution. A degreasing step may be necessary, for example, where the metal has been previously coated with lanoline or other oils or grease or with a plastic coating.

The alkaline cleaning solution is preferably a "non-etch" solution, that is, one for which the rate of etching of material from the metal surface is slow. A suitable alkaline cleaning solution is that commercially available under the trade name RIDOLINE 53.

The treatment with an alkaline cleaning solution is preferably conducted at an elevated temperature, such as up to 80° C., preferably up to 70° C.

Preferably the metal surface is rinsed with water between each of the above steps (a) to (c).

Treatment with the acidic, rare earth ion containing cleaning solution of step (b) is designed to remove smut left on the metal surface after step (a). The acidic, rare earth ion containing solution preferably comprises at least one rare earth compound dissolved in a mineral acid solution. The mineral acid may be sulphuric acid or nitric acid or a mixture of mineral acids such as sulphuric acid and nitric acid. However, preferably, the mineral acid is sulphuric acid. The rare earth ion solution. must be sufficiently acidic to assist in the removal of the smut on the metal surface. In most instances, this will necessitate a pH of less than 1, preferably less than 0.5.

Preferably the rare earth ion in the acidic, rare earth ion containing cleaning solution should possess more than one higher valence state. By "higher valence state" is meant a valence state above zero valency. Without wishing to be limited to one particular mechanism of smut removal, it is believed that the multiple valence states of the rare earth ion imparts a redox function enabling the rare earth ion to oxidise surface impurities and result in their removal as ions into solution. Such rare earth ions include cerium, praseodymium, neodymium, samarium, europium, terbium and ytterbium ions. The preferred rare earth ions are cerium ions and/or a mixture of rare earth ions. Preferably, the rare earth compound is cerium (IV) hydroxide, cerium (IV) sulphate, or ammonium cerium (IV) sulphate, while the mineral acid preferably is sulphuric acid.

The rare earth compound is present in the cleaning solution in an effective quantity and may be present in solution in a concentration up to saturation of the rare earth compound. Throughout the specification, values of concentration of rare earth ion in solution are mainly expressed as the equivalent grams of cerium per liter of solution. The acidic, rare earth ion containing cleaning solution may have in excess of 0.001 grams of the rare earth ion per liter of mineral acid solution. In some applications, the rare earth ion may be 10 ppm or above. The cleaning solution may furthermore have in excess of 0.01 grams, such as in excess of 0.014 grams per liter. However, for most applications of the invention, the cleaning solution has a concentration of rare earth ions of at least 0.1 g/l, such as 0.7 g/l (0.005M) or higher. It is preferred, however, that the minimum concentration of rare earth ions in the cleaning solution is 7.0 g/l (0.05M) and a concentration of at least 10 g/l may therefore be appropriate. The upper concentration limit of the rare earth ion in the cleaning solution is normally around 100 grams per liter, although in some embodiments, the concentration can be as high as 140 g/l (1M). However, there may be little cost benefit at such high concentrations. Usually concentrations of 80 g/l or below are more appropriate. Preferably, there is less than 70 grams, more preferably less than 50 grams, of the rare earth ion per liter of said solution. Preferably, the amount of rare earth ion does not exceed 30 grams per liter of solution. The concentration may advantageously be less than 21 grams/liter, such as less than 20 grams/liter. A suitable concentration for some applications is below 18 grams/liter such as less than 16 grams/liter. For these applications it is further preferred that the concentration be below 15 grams/liter, such as around 14 grams/liter and below.

The total concentration of mineral acid in the rare earth ion containing cleaning solution is preferably below 5 molar, such as below 4 molar. More preferably, however, the mineral acid has a concentration of up to 3 molar. For most applications, the mineral acid concentration is below 2.75 molar and in some embodiments it is 2.5M or lower. The lower concentration limit of the mineral acid may be 0.5 molar although under some conditions it can be as low as 0.1M. In some embodiments, the lower limit is preferably 1 molar. In preferred embodiments, a suitable concentration of mineral acid is above 1.7 molar such as up to about 2 molar.

If desired, the cleaning solution may optionally include one or more etch rate accelerators which increase the rate of etching of the metal surface. Inclusion of one or more of these etch rate accelerators in the cleaning solution may increase the rate of deposition of the subsequently applied conversion coating. Moreover, including one or more of these etch rate accelerators in the cleaning solution may lead to greater adhesion of a subsequently applied coating, in particular a conversion coating.

The etch rate accelerator may comprise one or more of the following species: halide ions, phosphate ions, nitrate ions and titanium ions. Of the halide ions, fluoride and/or chloride ions are preferred.

Fluoride ions may be added to the acidic, rare earth ion containing cleaning solution in the form of HF or, preferably, as ammonium bifluoride ($NH_4F.HF$) or potassium bifluoride (KF.HF). The preferred concentration of $F^-$ is less than 0.3M, such as up to approximately 0.2M. A suitable upper concentration is 0.15M. The lower limit of $F^-$ concentration may be 0.01M. In some embodiments, the lower limit of $F^-$ concentration is 0.015M. In a preferred embodiment, the concentration of $F^-$ is around 0.05M. The maximum preferred amount of $F^-$ in solution depends on whether $HNO_3$ is also present, as higher $F^-$ concentrations can exist with $HNO_3$ also present in solution.

Phosphate ions are preferably added to the rare earth ion containing cleaning solution as $H_3PO_4$. A preferred upper limit of phosphate concentration is 0.05M although for most applications 0.015M is a sufficient upper limit. The lower limit of phosphate concentration may be around 0.001M. However, preferably the phosphate ions are present in the cleaning solution at a concentration of 0.01M or higher, such as around 0.015M.

If desired, the cleaning solution may also include nitrate ions, preferably added in the form of $HNO_3$. $HNO_3$ may be present in the cleaning solution at a concentration of up to 160 g/l. However, for some embodiments of the invention a preferred concentration is around 80 g/l or below. In other embodiments, the concentration of nitrate ions is less than 50 g/l, such as less than 40 g/l. In another embodiment, the upper limit is around 10 g/l. The lower limit of $HNO_3$ concentration may be 1 g/l. In one embodiment, the $HNO_3$ concentration is around 3.15 g/l (0.05M).

If Ti ions and/or Cl ions are to be added to the cleaning solution, they are preferably added as $TiCl_4$. Another source of Ti ions is fluorotitanic acid, ($H_2TiF_6$). Titanium ions may be present up to 1000 mg/l. However, preferably Ti ions are present in solution at a concentration below 500 ppm (0.5 g/l), such as 300 ppm (0.3 g/l) or below. In some embodiments, the lower limit of $Ti^{4+}$ concentration may be around 10 mg/l. In a preferred embodiment, the concentration of Ti ions is 145ppm (0.145 g/l).

If the rare earth ion containing cleaning solution includes as an etch rate accelerator chloride ions, they are preferably present in solution up to a concentration of 0.01 molar, such as up to 0.006 molar. Where chloride ions are added in the form of $TiCl_4$, the amount of chloride ions in solution is preferably the stoichiometric equivalent of the preferred concentration of Ti ions, that is, four times the molarity.

As previously described, the rare earth ion containing cleaning solution preferably comprises a rare earth compound dissolved in a mineral acid solution. If the cleaning solution includes one or more etch rate accelerators which are mineral acids themselves (such as HF, $H_3PO_4$, $HNO_3$), the cleaning solution effectively comprises a rare earth compound dissolved in a mixture of two (or more) mineral acids. In such a solution, the total concentration of mineral acid is preferably no greater than 5 molar.

Under some circumstances, the rare earth ion containing solution may beneficially contain additional oxidising agent, such as peroxide or persulphate, in order to assist in the oxidation and removal of smut into solution.

The rare earth ion containing cleaning solution is used at a temperature less than 100° C., such as below 85° C., preferably below 80° C. In some applications, the temperature may be below 70° C., and for those applications, the preferred maximum temperature is from 50 to 60° C. Preferably, the rare earth ion containing cleaning solution has a temperature of 45° C. or lower and, more preferably, the temperature is around 35° C. However, the solution may also be used at temperatures around ambient temperature such as from 10 to 30° C.

The metal is treated with the acidic, rare earth ion-containing cleaning solution for a period of time sufficient to remove surface smut to the desired degree. Preferably the metal is treated for less than 1 hour, such as up to 50 minutes. In some embodiments, the metal may be cleaned for up to 45 mins such as 30 mins or below. In other applications, the metal is cleaned for up to 20 mins, such as for a maximum of 15 mins. The lower time limit may be as short as about 1 second or it may be longer, such as 5 mins. Alternatively, the minimum period of time may be around 10 minutes.

The etch rate of the rare earth element containing cleaning solution varies according to the composition of the metal or metal alloy. In general, the etch rate can be increased by increasing the temperature of the cleaning solution. Also, as previously discussed, additives such as fluoride ion and/or $HNO_3$ may increase the rate of etching of the metal surface by the rare earth element containing cleaning solution.

The rare earth ion containing coating solution of step (c) also contains at least one rare earth ion having variable valence. Again, the preferred rare earth ion is cerium and/or a mixture of rare earth ions. It is particularly preferred that the rare earth ion be introduced into solution in the form of a soluble salt, such as cerium (III) chloride. However other suitable salts include cerium (IV) sulphate or cerium (III) nitrate. It is further preferred that the cerium be present in solution as $Ce^{3+}$ cations. Accordingly, when the metal surface is reacted with the coating solution, the resulting pH increase at the metal surface indirectly results in a precipitation of a Ce IV compound on the metal surface. However, the cerium can be present in the solution as $Ce^{4+}$, if required.

The rare earth ion may be present in the coating solution at a concentration below 50 grams/liter, such as below 40 g/l. Preferably, the rare earth ion is present at a concentration up to 38 g/l. More preferably, the rare earth ion concentration is below 10 g/l, such as below 5 g/l, preferably below 4 g/l. A suitable concentration is 3.8 g/l and below. The lower concentration limit may be 0.038 g/l, such as 0.38 g/l and above.

The coating solution may also contain an oxidising agent. The oxidising agent, if present, is preferably a strong oxidant, such as hydrogen peroxide. It may be present in solution in a concentration up to the maximum commercially available concentration (usually around 30 volume %). Alternatively, the $H_2O_2$ may have a maximum concentration of 9 volume %. In some embodiments, the $H_2O_2$ concentration is below 7.5%, preferably below 6%, more preferably below 3%. Advantageously, the $H_2O_2$ content is low, such as below 1%, preferably below 0.9%, for example about 0.3%. The $H_2O_2$ concentration is preferably above 0.03%, such as above 0.15%.

The coating solution may also include a surfactant, in an effective amount, in order to lower the surface tension of the solution and facilitate wetting of the metal surface. The surfactant may be cationic or anionic. Inclusion of a surfactant is beneficial in that by reducing surface tension of the coating solution, it thereby minimises "drag-out" from the solution. "Drag-out" is an excess portion of coating solution which adheres to the metal and is removed from solution with the metal and subsequently lost. Accordingly, there is less waste and costs are minimised by adding surfactant to the coating solution. The surfactant may be present in solution at a concentration up to 0.01%, such as 0.005%. A suitable concentration may be up to 0.0025%.

The pH of the coating solution is acidic and may be below 4, such as below 3.0, preferably below 2.8. Advantageously the pH is adjusted to a value below 2.5, such as 2.0 or below, prior to the addition of the oxidant. The lower limit of solution pH may be 0.5 and is preferably about 1.0, such as above 1.5.

The coating solution is used at a solution temperature below the boiling temperature of the solution. The solution temperature may be below 100° C., such as below 95° C., preferably up to 75° C., more preferably up to 50° C. The lower temperature limit is preferably ambient temperature.

The metal surface is contacted with the coating solution for a period of time sufficient to give a desired coating thickness. A suitable coating thickness is up to 1 $\mu$m, such as less than 0.8 $\mu$m, preferably less than 0.5 $\mu$m. Preferably, the coating thickness is the range 0.1 to 0.2 $\mu$m.

The cleaning and coating steps may be followed by a sealing step. Preferably, the coated metal surface is rinsed prior to and after the sealing process. The rare earth coating may be sealed by treatment with one of a variety of aqueous or non-aqueous inorganic, organic or mixed sealing solutions. The sealing solution forms a surface layer on the rare earth coating and may further enhance the corrosion resistance of the rare earth coating. Preferably the coating is sealed by an alkali metal silicate solution, such as a potassium silicate solution. An example of a potassium silicate solution which may be used is that commercially available under the trade name "PQ Kasil #2236". Alternatively, the alkali metal sealing solution may be sodium based, such as a mixture of sodium silicate and sodium orthophosphate. The concentration of the alkali metal silicate is preferably below 20%, such as below 15%, more preferably 10% or below. The lower concentration limit of the alkali metal silicate may be 0.001%, such as above 0.01%, preferably above 0.05%.

The temperature of the sealing solution may be up to 100° C., such as up to 95° C., preferably up to 90° C. more preferably below 85° C., such as up to 70° C. The lower limit of the temperature is preferably ambient temperature, such as from 10° C. to 30° C.

The coating is treated with the sealing solution for a period of time sufficient to produce the desired degree of sealing. A suitable time period may be up to 30 minutes, such as up to 15 minutes, and preferably is up to 10 minutes. The minimum period of time may be 2 minutes.

The silicate sealing has the effect of providing an external layer on the rare earth element coating.

BRIEF DESCRIPTION OF THE DRAWINGS

The invention will become more readily apparent from the following exemplary description in connection with the accompanying drawings and Examples.

DETAILED DESCRIPTION OF THE PREFERRED EMBODIMENTS

Figure 1:
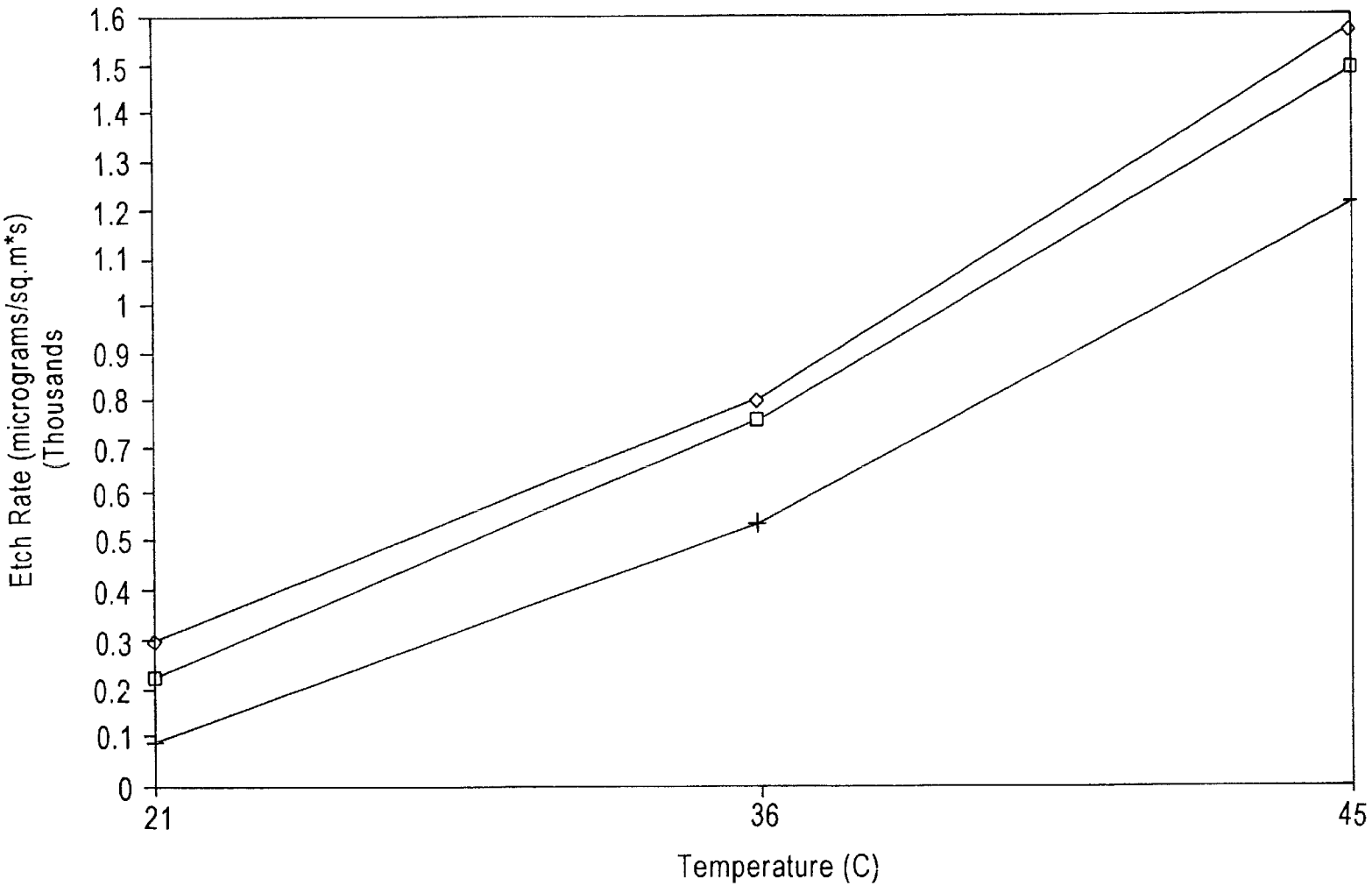
FIG. 1 is a graph showing etch rate vs temperature for aluminium alloys contacted with a rare earth ion containing cleaning solution. Squares represent 2024 aluminium alloy, crosses represent 6061 aluminium alloy and diamonds represent 7075 aluminium alloy.

In an embodiment of the invention, aluminium or an aluminium alloy is cleaned and conversion coated in the following fashion.

The aluminium or aluminium alloy is first immersed in an alkaline cleaning solution. This step may be preceded by degreasing in a suitable liquid, such as trichloroethane. However, with the advent of new generation aqueous cleaning solutions the two-step process can be replaced with a single dip in an aqueous alkaline solution. However, the two step process is preferred over the single step process. The step of alkaline cleaning is followed by a rinse in water.

The aluminium or its alloy is then cleaned by treatment with an acidic solution containing rare-earth ions. The concentration of rare earth element is preferably around 0.1 molar. Accordingly, the solution comprises 21.0 g of cerium (IV) hydroxide or 35 g of cerium (IV) sulphate, or 65 g of ammonium cerium (IV) sulphate per liter of solution to give approximately 14 g of cerium ion per liter of solution.

When the acidic, rare earth ion containing cleaning solution is made from cerium (IV) hydroxide and sulphuric acid it is preferred that 21 g of cerium (IV) hydroxide be dissolved in 100 ml of concentrated sulphuric acid and the resultant solution be diluted to 1 liter with distilled water.

When cerium (IV) sulphate is used for the rare earth ion containing cleaning solution it is preferred that 35 g of cerium (IV) sulphate is dissolved in 200 ml of 50 percent v/v sulphuric acid and the resultant solution diluted to 1 liter of distilled water.

When ammonium cerium (IV) sulphate is used for the rare earth ion containing cleaning solution it is preferred that 65 g of ammonium cerium (IV) sulphate be dissolved in 200 ml of 50 percent v/v sulphuric acid and the resultant solution diluted to 1 liter with distilled water.

The aluminium or its alloy is then immersed in the rare earth ion containing cleaning solution for between two and sixty minutes at a temperature up to boiling point of the solution, such as between 10° C. and 100° C. It is preferred that the immersion time be five minutes and the immersion temperature be at 20° C. There is generally a visible brightening of the surface indicating smut removal.

FIG. 1 of the drawings illustrates the variation in etch rate of an aluminium alloy surface with a rare earth ion containing cleaning solution as a function of temperature and alloy composition. Each alloy was first degreased with BRULIN at 60° C. for 10 minutres and then contacted with a RIDOLINE solution at 70° C. for 4 minutes, prior to treatment with the rare earth cleaning solution. The cleaning solution contains 0.05 molar Ce ions (added as $(NH_4)_2Ce(IV)SO_4)_3$ and 0.5 molar $H_2SO_4$. The three aluminium alloys, in order of decreasing copper content, are the alloys 2024, 7075 and 6061. As can be seen, for any given temperature of the cleaning solution, the rate of etching a 7075 aluminium alloy is highest, followed by 2024 aluminium alloy, then 6061 aluminium alloy. It is also apparent that, at least under the range of conditions of FIG. 1, increasing temperature of the cleaning solution results in an increase in etch rate of each alloy. At around ambient temperature (eg. 21° C.) the etch rate of the cleaning solution is in the vicinity of 200 $\mu g/m^2s$.

Figure 2:
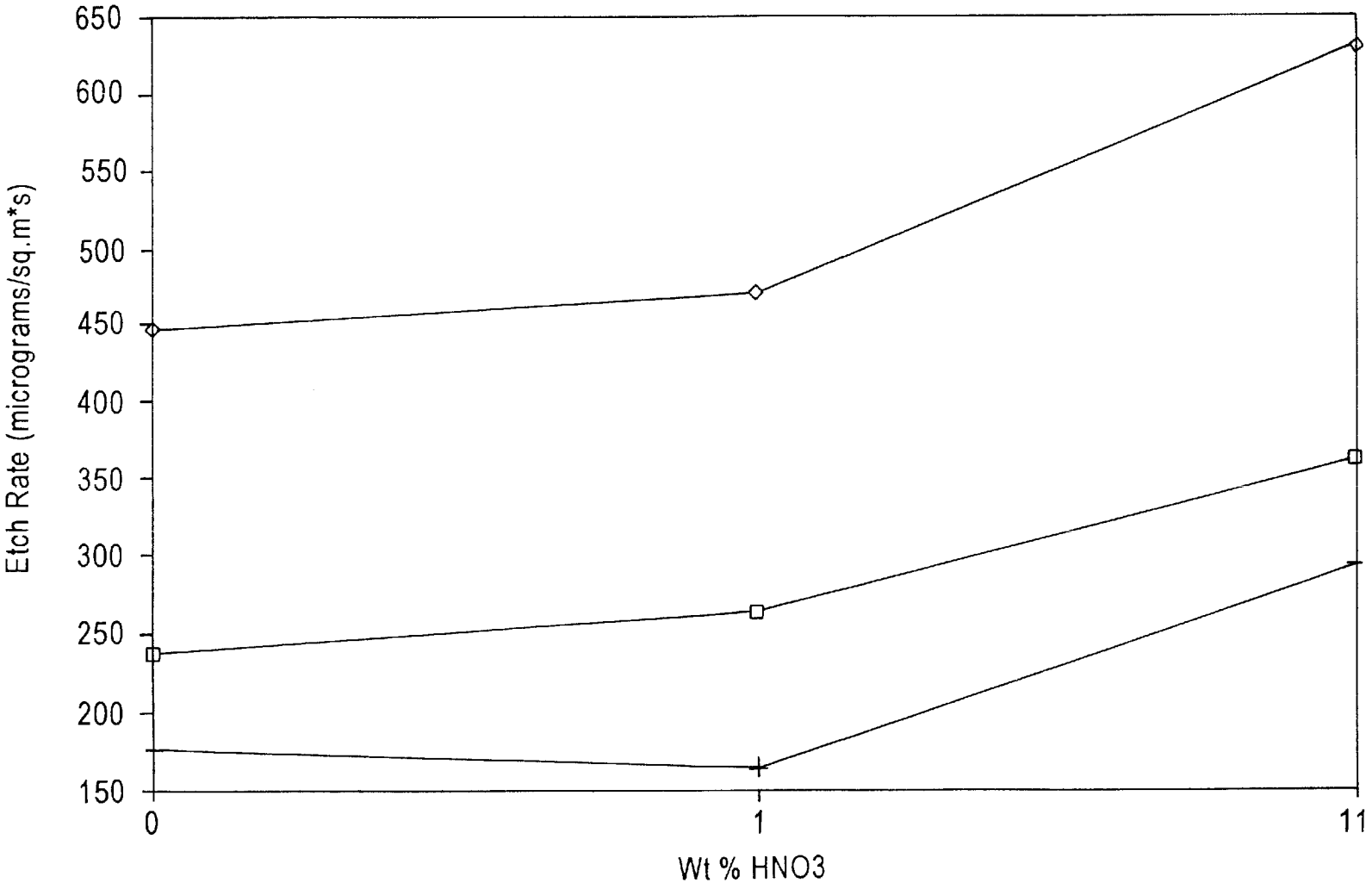
FIG. 2 is a graph showing etch rate vs wt % $HNO_3$ for aluminium alloys contacted with a rare earth ion containing cleaning solution having varying concentration of $HNO_3$. Squares represent 2024 aluminium alloy, crosses represent 6061 aluminium alloy and diamonds represent 7075 aluminium alloy.

FIG. 2 illustrates the variation in etch rate of a rare earth element containing cleaning solution having added $HNO_3$ at ambient temperature (21° C.) as a function of alloy composition and concentration of $HNO_3$. The alloy is first degreased and treated with RIDOLINE, as for FIG. 1. The rare earth cleaning solution also contains 0.1 molar Ce ions (added in the form of $Ce(OH)_4$) and 2 molar $H_2SO_4$. Similarly to FIG. 1, FIG. 2 shows that the alloys in order of increasing etch rate for any given concentration of $HNO_3$ are: 6061, 2024 and 7075. However, for each alloy, only relatively high additions of $HNO_3$ have any marked effect on the etch rate, at least under the range of conditions depicted in FIG. 2. However, for 6061 alloy, there is an apparent small decrease in etch rate between 0 and 1 wt %. Above 1 wt % $HNO_3$, the etch rate for all three alloys increases markedly.

Figure 3:
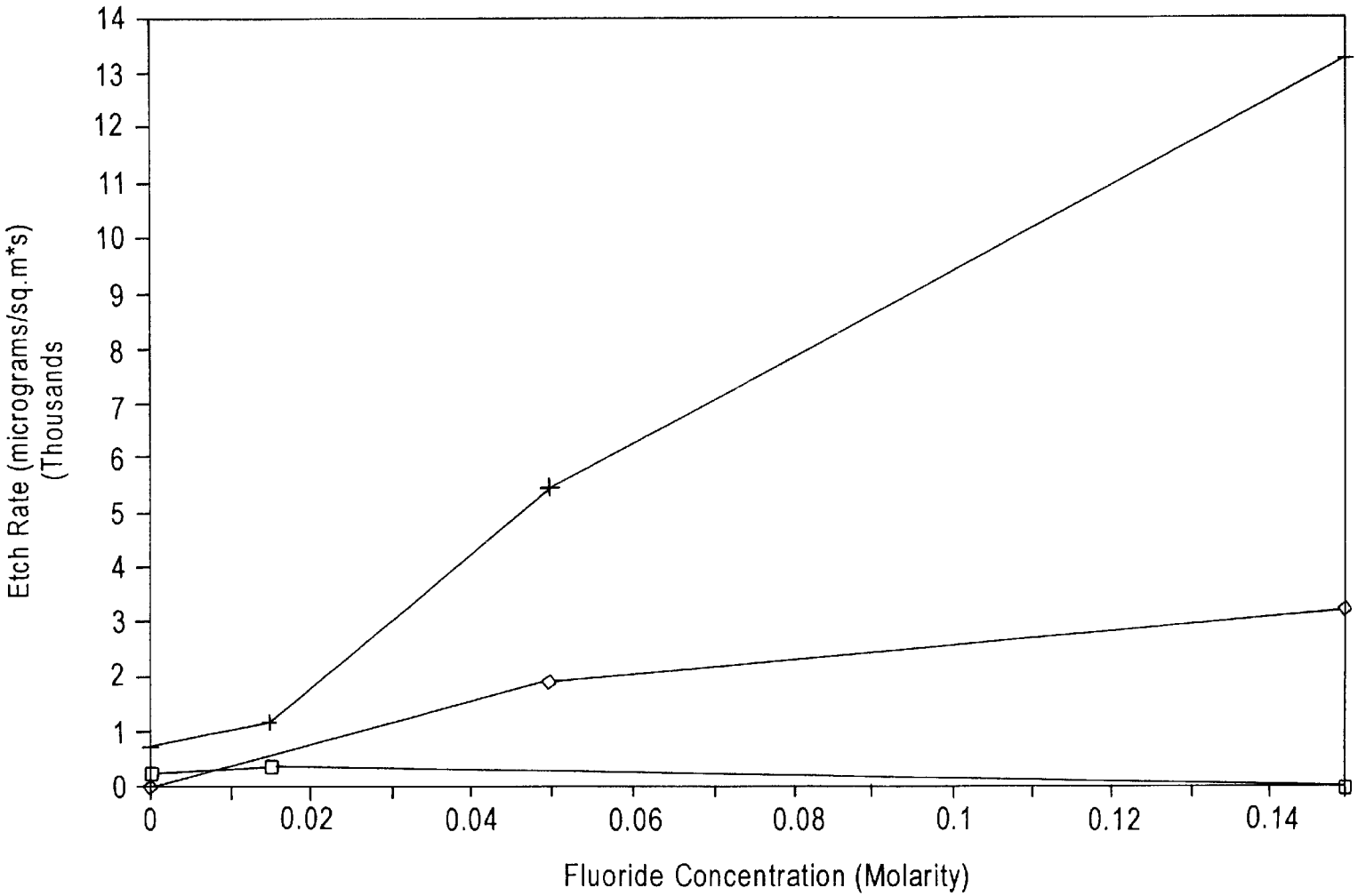
FIG. 3 is a graph showing etch rate vs fluoride molarity for a 2024 aluminium alloy contacted with a rare earth ion containing cleaning solution having varying concentration of $F^-$. Squares represent a solution temperature of 21° C., crosses represent the same solution at a temperature of 35° C. and diamonds represent a solution having a composition including 0.05M $HNO_3$ and a temperature of 35° C.

Addition of $F^-$ to the rare earth cleaning solution increases considerably the etch rate of the cleaning solution, as demonstrated by FIG. 3. In FIG. 3, etch rate of a 2024 aluminium alloy is plotted as a function of fluoride molarity for a solution temperature of 21° (squares), a solution temperature of 35° C. (crosses) and a solution at 35° C. and containing 0.05M $HNO_3$ (diamonds). The cleaning solution contains 0.05 molar Ce ions (added as ammonium cerric sulphate) and 0.5 molar $H_2SO_4$ as well as additional fluoride ions. Elevation of the temperature, at least under the conditions shown in FIG. 3, increases etch rate. The alloy was first degreased and treated with RIDOLINE using the same conditions as for FIGS. 1 and 2. At a solution temperature of 35° C., addition of $F^-$ to give a concentration of 0.15M results in almost two orders of magnitude increase in etch rate, to approximately 14,000 $\mu g/m^2S$. At such high rates of etching, however, the alloy surface may undergo excessive pitting and/or blackening due to smut buildup. This effect may be reduced or eliminated by addition of an effective amount of $HNO_3$ in order to reduce the level of etching, in particular, local etching in the form of pitting. Addition of $HNO_3$ may also brighten the surface of the metal alloy by removing smut. FIG. 3 shows that the addition of 0.05M $HNO_3$ to a fluoride ion and rare earth ion containing cleaning solution at a temperature of 35° C., reduces the etch rate of a 2024 aluminium alloy considerably for the particular conditions illustrated.

Figure 4:
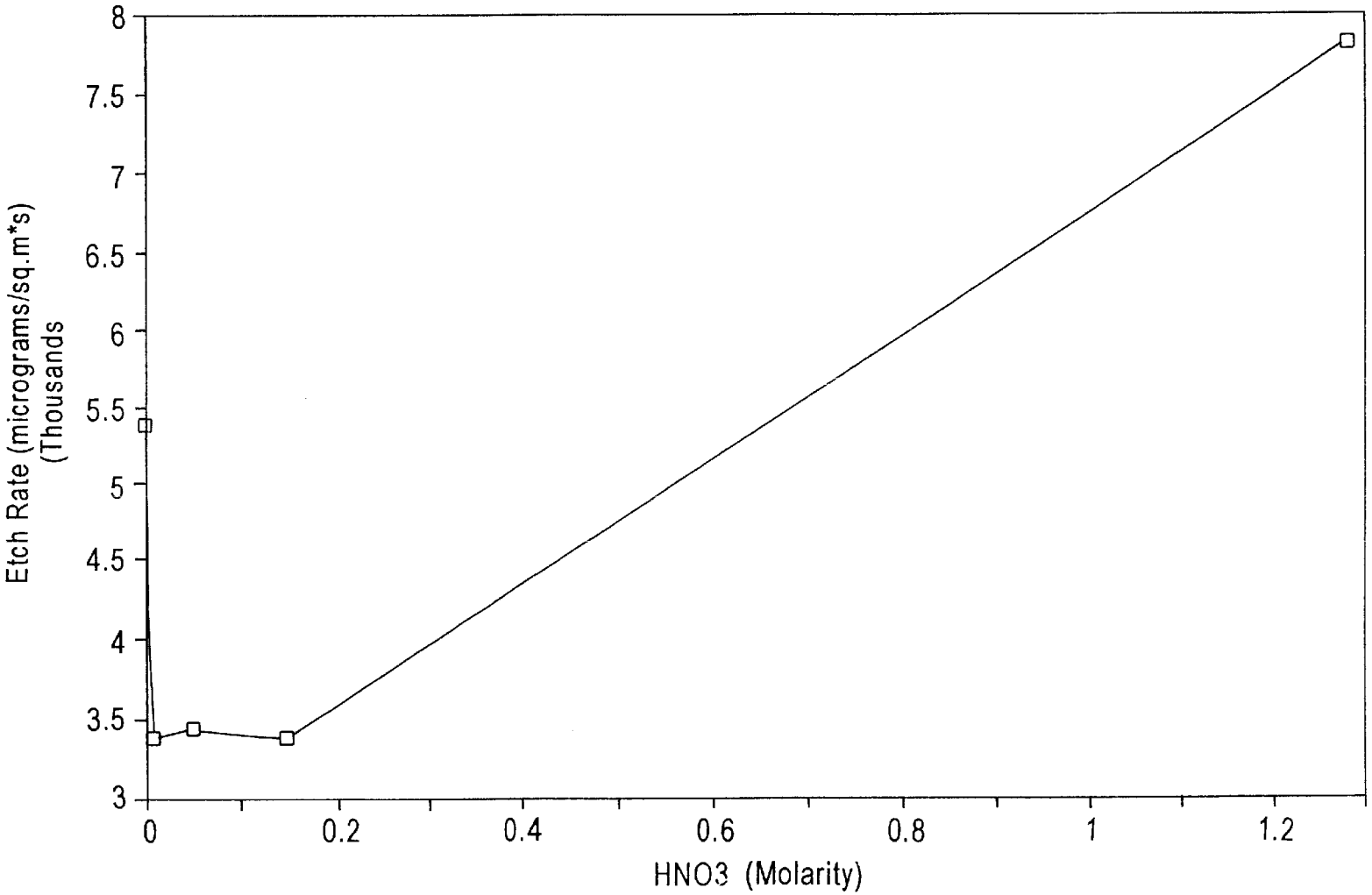
FIG. 4 is a graph showing etch rate vs $HNO_3$ molarity for a 2024 aluminium alloy contacted with a rare earth ion containing cleaning solution having a temperature of 35° C.

FIG. 4 also shows the effect of $HNO_3$ on etch rate of a 2024 aluminium alloy by a rare earth ion containing cleaning solution at 35° C. The alloy was first treated with BRULIN and RIDOLINE as for FIGS. 1 to 3. The cleaning solution also contains 0.05 molar Ce ions (added as ammonium cerric sulphate), 0.5 molar $H_2SO_4$ and 0.05M fluoride ion. Addition of a very small concentration of $HNO_3$ (such as 0.005M) is sufficient to significantly lower the etch rate of the solution, such as by 2000 $\mu g/m_2s$ and the presence of $HNO_3$ at small concentrations depresses etch rate more than larger concentration of $HNO_3$.

A preferred rare earth element containing solution is one having a solution composition similar to that of FIG. 2 (having 0.1 molar Ce ions added as $Ce(OH)_4$ and 2 molar $H_2SO_4$) and 0.05M $F^-$, preferably in the form of potassium bifluoride (KF.HF) or ammonium bifluoride ($NH_4F.HF$), and 1.28M $HNO_3$.

Another preferred rare earth element containing solution is one having a solution composition similar to FIGS. 1, 3 and 4 (having 0.05 molar Ce ions, added as $(NH_4)_2Ce(IV)SO_4)_3$ and 0.5 molar $H_2SO_4$) and 0.05M $F^-$, preferably in the form of potassium bifluoride (KF.HF) or ammonium bifluoride ($NH_4F.HF$) and 1.28M $HNO_3$. At these concentrations, the etch rate of a 2024 aluminium alloy by the solution at 35° C. is $2.9\times10^{-4}$ inchs/surf/hr.

A further preferred rare earth ion containing cleaning solution is one having 1.28M $HNO_3$, 0.04M $F^-$ (in the form of a bifluoride, eg. $NH_4F.HF$ at 0.02M) and 0.05M Ce (in the form of $(NH_4)_2Ce(NO_3)_6$). The etch rates for this solution are 4.5 and $2.4\times10^{-4}$ respectively for 35° C. and room temperature.

Acidic rare earth cleaning is preferably followed by a rinse in water.

If it is desired to conversion coat the cleaned aluminium or alloy, a coating solution is formed by adding a cerium salt, preferably cerium (III) chloride, to water to produce an aqueous cerium salt solution. The concentration of the cerium salt solution is preferably between 0.1 and 10 wt %. The solution pH is then adjusted to a value below 2.5, preferably below 2.0. At such pH value, cerium is present in solution substantially completely in the +3 oxidation state. An oxidant, preferably hydrogen peroxide, may then be added at a concentration in the range of 0.15 to 9%. Preferably the hydrogen peroxide is present at a concentration of about 0.3%.

Although the preceding paragraph describes pH adjustment first, then addition of oxidant, it is not mandatory to conduct these steps in this order. Addition of oxidant may therefore precede pH adjustment.

The metal is then immersed in the coating solution preferably for 5 minutes at 45° C., resulting in a local rise in pH at the metal surface. This pH rise indirectly enables oxidation of $Ce^{3+}$ to $Ce^{4+}$. Once the pH rises to a value above that required to precipitate Ce in the +4 oxidation state, a cerium compound is precipitated onto the metal surface. The cerium compound contains cerium and oxygen.

Figure 5A:
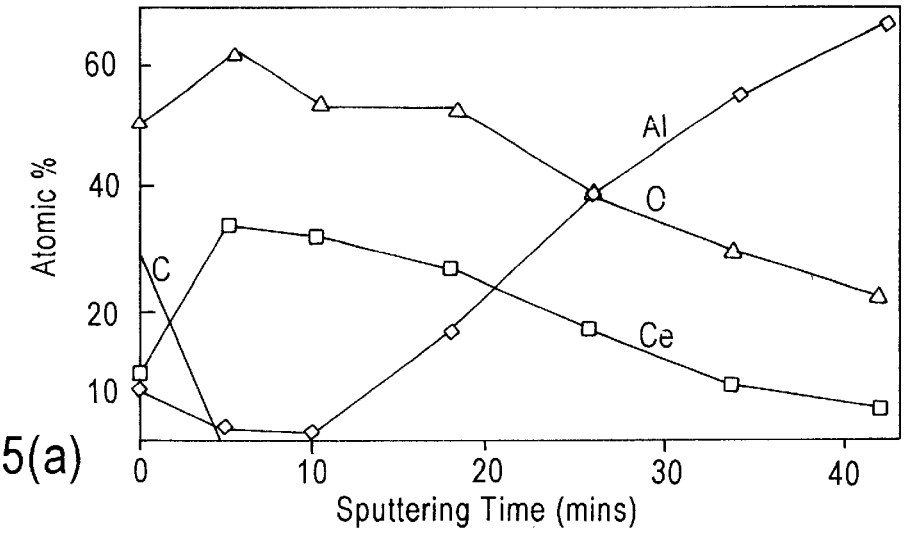
FIG. 5 is an X-ray photoelectron spectroscopy depth profile showing the depth distribution of elements in a cerium containing conversion coating. Part (a) shows atomic % of major components, part (b) shows atomic % of minor components and part (c) shows % species, all vs sputtering time (minutes).
Figure 5B:
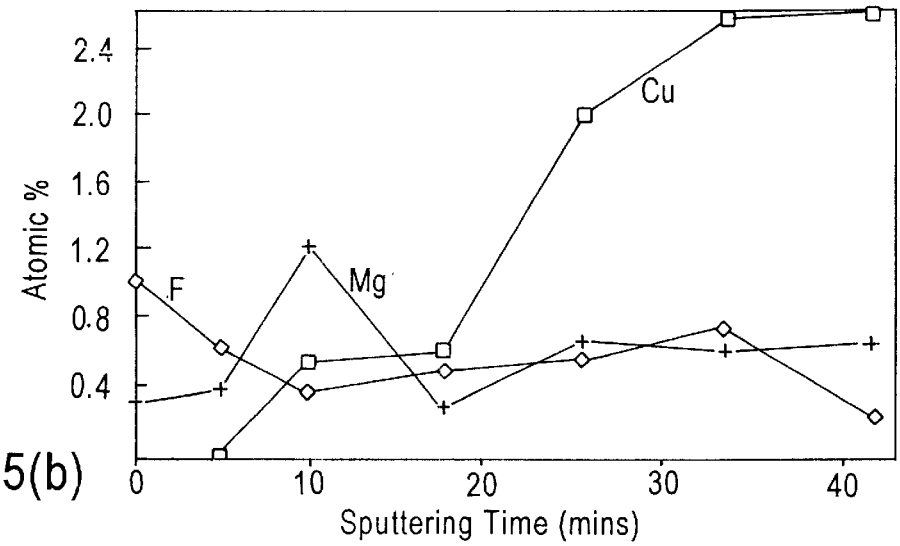
Figure 5C:
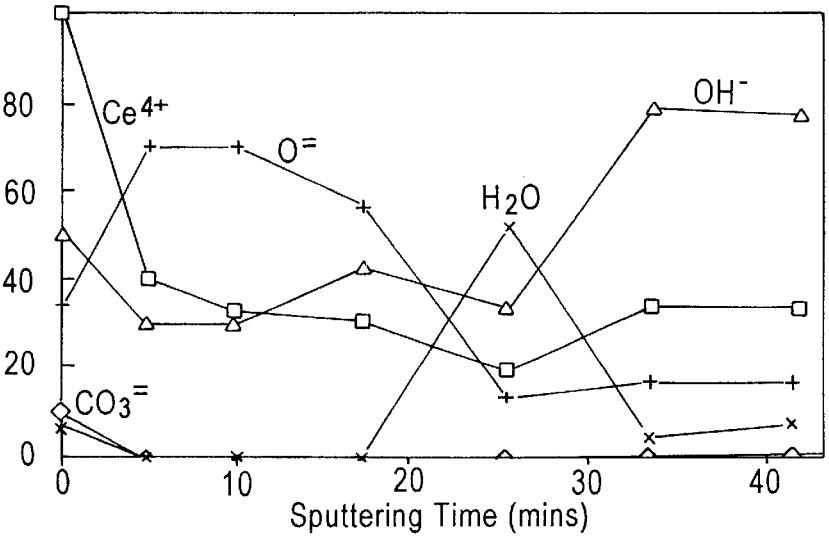

The depth distribution of elements in the resulting cerium-containing coating is depicted in the X-ray photoelectron spectroscopy depth profile of FIG. 5.

In FIG. 5, sputtering time is proportional to depth from the surface of the sample. Accordingly, at short sputtering times, the values of atomic % and % species represent the composition near the surface of the sample and those values at long sputtering times represent the composition at depth.

Part (a) of FIG. 5 show the atomic % of Ce and O decreasing, and atomic % of Al increasing, with depth. Accordingly, the surface coating of the sample includes cerium and oxygen. As sputtering of the surface progresses, more of the coating is removed, resulting in increasing exposure of the substrate aluminium alloy.

Part (b) of FIG. 5 also shows increasing Cu content with longer sputtering time, representing exposure of the copper in the substrate alloy at the conversion coating/alloy interface.

Part (c) of FIG. 5 shows the depth distribution of various species in the surface of the sample. It is noted that the amount of $Ce^{4+}$ initially decreases very rapidly for the first five minutes of sputtering time, while over the same interval $O^{2-}$ increases steeply. Thereafter, $Ce^{4+}$ decreases less rapidly to approximately 26 minutes of sputtering time, after which it increases slightly and levels out. The depth profile results clearly indicate that the conversion coating is predominantly a hydrated cerium oxide.

The cerium coating is then sealed by immersion in a 0.05 vol % to 10 vol % potassium silicate solution at a temperature ranging from 10 to 90° C. and for 2 to 30 minutes. Preferably the immersion is for 10 minutes at 20° C.

Figure 6A:
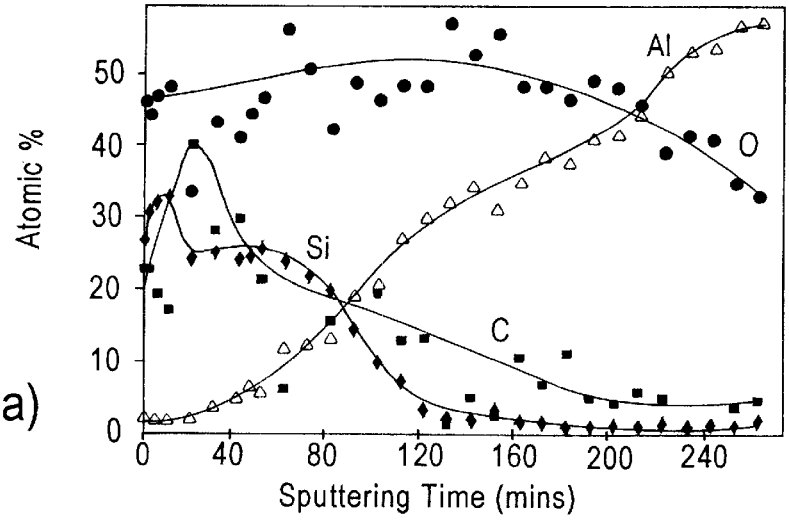
FIG. 6 is an X-ray photoelectron spectroscopy depth profile for a sealed, cerium containing conversion coating. Part (a) shows atomic % of major components, part (b) shows atomic % of minor components and part (c) shows % of total signal, all vs sputtering time (minutes).
Figure 6B:
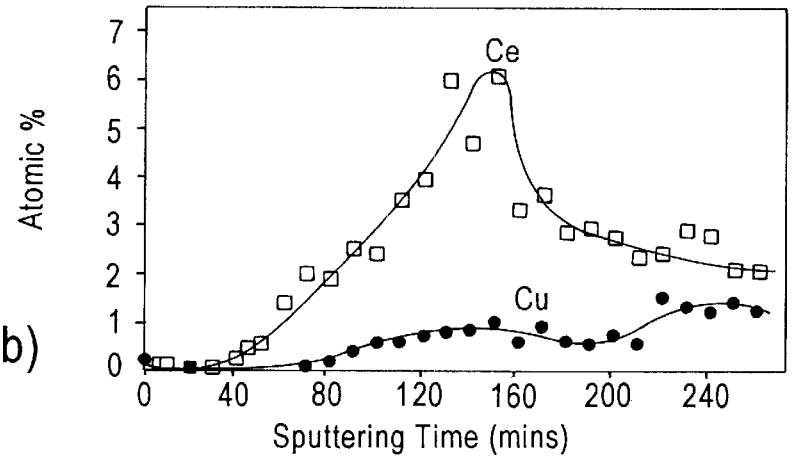
Figure 6C:
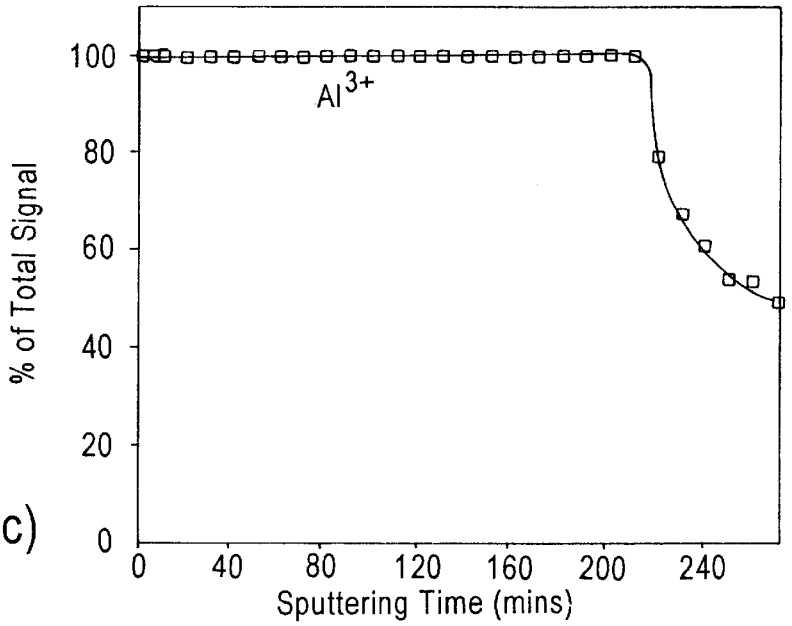

An X-ray photoelectron spectroscopy depth profile for the sealed cerium coating is given in FIG. 6.

Again, sputtering time is proportional to depth from the surface of the sample.

Part (a) of FIG. 6 shows a general decrease in the amount of Si with depth, as sputtering removes the silicate sealing layer over time. The amount of Al steadily rises with sputtering time, in a similar manner to that shown in FIG. 5 and likewise indicates increasing exposure of the aluminium alloy substrate. The level of O remains almost constant then begins to decrease at approximately 140 minutes of sputtering time.

Part (b) of FIG. 6 shows a peak in the amount of Ce around 140 minutes as the rare earth coating is revealed by sputtering. Similarly to FIG. 5, the copper level increases with sputtering time as more of the aluminium alloy substrate (containing Cu) is revealed.

Part (c) of FIG. 6 shows that the aluminium signal consists entirely of aluminium in its +3 oxidation state until approximately 200 minutes, after which the proportion of $Al^{3+}$ begins to decrease with $Al^0$ constituting most of the Al signal (presumably because the substrate metal including aluminium in its zero oxidation state is encountered). In any area of the surface prior to silicate sealing where there is only aluminium oxide, due to an incomplete rare earth coating, it is believed that the silicate sealing solution reacts with the aluminium oxide and forms an insoluble aluminosilicate. The $Al^{3+}$ detected by XPS is probably present in the form of aluminosilicate.

The following Examples illustrate, in detail, embodiments of the invention.

In Examples 1 to 39, the metal substrate used was 2024 aluminium alloy. The 2024 aluminium alloy is part of the 2000 series alloys, which is one of the most difficult to protect against corrosion, particularly in a chloride ion containing environment. Such environments exist, for example, in sea water, or exposure to sea spray and around airport runways (where salt may be applied to the runways).

In Examples 1 to 39, corrosion resistance is. measured by the amount of time it takes for the metal to develop pitting in a neutral salt spray (NSS), according to the standard salt spray tests described in American Standard Testing Method B117. Time to pitting of 20 hours and above is considered acceptable for most applications.

Examples 40 to 57 demonstrate the effect of additives to the rare earth element containing cleaning solution on the subsequent time taken to coat the-metal alloy surface with a conversion coating. In all of Examples 40 to 57, the times given are those required to produce a golden conversion coating when the metal is subsequently treated with a rare earth element containing coating solution.

All conversion coated Examples were found to have good paint adhesion properties when subsequently tested according to American Standard Testing Method D2794. The paint adhesion properties were similar to or better than the properties of alloys coated with chromate conversion coatings.

Moreover, metal surfaces treated with the acidic rare earth cleaning solution of the invention were observed to undergo a visible brightening. Furthermore, the metal surfaces pretreated with the rare earth solution exhibited significantly shorter coating times, when subsequently treated with a rare earth coating solution, than those coating times for metal surfaces cleaned with chromate based cleaning solutions. It is believed that chromate coating solutions leave a "passivation" film on the metal surface which must be penetrated by the subsequently applied coating solution, hence requiring a longer coating time.

EXAMPLES 1 to 4

2024 aluminium alloy plates were pretreated with an acidic rare earth ion containing cleaning solution and then coated with a rare earth coating solution in the following manner.

Step 1: a preliminary degrease in an aqueous degreasing solution for 10 minutes at 60–70° C. instead of the standard degrease in trichloroethane.

Step 2: alkaline clean in a "non-etch" alkaline solution at 60–70° C. for 4 minutes.

Step 3: acid clean in a rare earth ion containing pretreatment solution for 5 minutes at room temperature. There was a visible brightening of the metal surface after cleaning, indicating removal of smut formed in Step 2.

Step 4: immersion for 5 minutes at 45° C. in an acidic rare earth coating solution containing $CeCl_3.7H_2O$ at the concentrations given in Table I with the addition of 0.3% $H_2O_2$, at a pH of 1.9.

Step 5: sealed in potassium silicate (PQ Kasil #2236, 10%) solution at room temperature for 10 minutes.

All steps were followed by a 5 minute rinse in water, except Step 5 which was followed by a 1 minute rinse.

Table I shows the concentration of $CeC_3.7H_2O$ in Step 4 for Examples 1 to 4 and the resultant coating time (C.T.), salt spray test performance (NSS=Time to pitting in Neutral Salt Spray) and coating characteristics. It should be noted that salt spray testing result for Example 3 is the time at which the particular test ceased during which time the Example had not developed pits.

Accordingly, the time to pitting of Example 3 is in excess of 336 hours.

TABLE I

Cerium Concentration in Coating Solution

| | $CeCl_3.7H_2O$ (g/l) | Ce (g/l) | NSS (hrs) | Coating Form | Coating Time (mins) |
|---|---|---|---|---|---|
| EX. 1 | 0.1 | 0.038 | <20 | not visible | 60 |
| EX. 2 | 1 | 0.38 | 20 | thin coating | 30 |
| EX. 3 | 10 | 3.80 | 336 | golden coating | 5 |
| EX. 4 | 100 | 38 | 50 | thick, patchy coating | 2 |

Examples 1 to 3 show that with increasing cerium concentration in the coating solution, coating time decreases with an attendant increase in corrosion resistance. However, Example 4 shows that at higher cerium concentration, while coating time is reduced, there is no improvement in corrosion resistance.

Accordingly, it appears that for the specific cases illustrated in Examples 1 to 4, the maximum, cost beneficial concentration of cerium in the coating solution is between 3.8 and 38 grams/liter. However, there could be cost benefit in higher cerium concentrations when other parameters of the coating and/or cleaning processes are varied.

EXAMPLES 5 AND 6

Variations on Examples 1–4 were obtained by changing the $H_2O_2$ concentration in step 4 of Examples 1–4. Hence, Step 4 of Examples 5 and 6 comprises: immersion in a rare earth coating solution containing $CeCl_3.7H_2O$ at a concentration of 10 g/l with $H_2O_2$ concentrations given in Table II at pH of 1.9 for the immersion times given in Table II at 45° C.

TABLE II

Hydrogen Peroxide Concentration

| | $H_2O_2$ Concentration (v/v %) | Coating Time (secs) | NSS (hrs) | Coating Form |
|---|---|---|---|---|
| EX. 5 | 3 | 30 | 20 | Thick Patchy |
| EX. 6 | 9 | 30 | 20 | Thick Patchy |

Examples 5 and 6 illustrate that under the specific set of conditions for each Example, an increase in $H_2O_2$ concentration above 3 vol % does not substantially affect coating time or corrosion performance. However, it may be appropriate to use different concentrations of $H_2O_2$ where other parameters have been varied.

EXAMPLES 7,8

The temperature of immersion in Step 4 of Examples 1 to 4 was varied according to the values given in Table III. The concentration of cerium in the coating solution was 3.8 g/l.

TABLE III

| | Temperature of Immersion | | | |
|---|---|---|---|---|
| | T (° C.) | NSS (hrs) | Coating Form | Coating Time |
| EXAMPLE 7 | Ambient | 90 | Non-uniform | 1.5 hours |
| EXAMPLE 8 | 90 | 50 | Uniform | 1 min. |

Under the particular, respective, sets of conditions for Examples 7 and 8, the coating time decreased with increasing temperature of immersion of the metal in the coating solution. The coating times were still considerably shorter than these for chromate pretreated metal surfaces. Moreover, a more uniform coating is applied at higher temperatures. Both Examples displayed acceptable corrosion resistance.

EXAMPLES 9–11

Comparison of corrosion resistance and coating characteristics at varying pH values of the coating solution in Step 4 of Examples 1 to 4 are provided in Table IV. The concentration of cerium in the coating solution was 3.8 g/l. The Examples show that as the pH is lowered it takes longer to deposit the coating and as the pH increases the coating becomes more powdery and the solution less stable. Thus, it appears from the specific embodiments shown in the Examples that the maximum pH of the coating solution is below 3.0. However, where other parameters of the coating process are varied, different values of pH of the coating solution may be appropriate.

TABLE IV

| | pH of Immersion | | | |
|---|---|---|---|---|
| | pH | NSS (hrs) | Coating Characteristics | Coating Time (mins) |
| EXAMPLE 9 | 1.0 | 20 | Uniform | 60 |
| EXAMPLE 10 | 2.0 | 336 | Uniform, golden | 5 |
| EXAMPLE 11 | 3.0 | 10 | Uniform, powdery | 10 |

EXAMPLES 12 AND 13

Using the same pretreatment as Examples 1 to 4, fluoro-chemical surfactant was added to the coating solution of Step 4. The addition of 0,0025% of fluoro-chemical surfactant was found to lower the surface tension of the solution from 64 to 20 dynes/cm and reduce drag-out from the solution. The concentration of cerium in the coating solution was 3.8 g/l.

TABLE V

| | | Surface Tension dynes/cm | Drag-Out $L/m^2$ |
|---|---|---|---|
| EXAMPLE 12 | (Without Surfactant) | 64 | 0.034 |
| EXAMPLE 13 | (With Surfactant) | 20 | 0.010 |

EXAMPLES 14 TO 24

The rare earth conversion coating can be sealed in a number of different solutions. In these Examples Steps 1 to 4 are the same as for Examples 1 to 4, but for the sealing Step 5 the composition of the sealing solution and treatment time was changed as shown in Table VI. The coating solution has a cerium concentration of 3.8 g/l.

TABLE VI

| | Composition of Sealing Solution | |
|---|---|---|
| | Sealing Solution | Corrosion Resistance NSS (hrs) |
| EXAMPLE 14 | Polyvinyl alcohol 1%, potassium dichromate 0.2% in aqueous solution. | 87 |
| EXAMPLE 15 | Polyacrylic acid 3% (M.w. = 750000) 25% (M.W. = 49000) in aqueous solution at 70° C. for 1 h. | 65 |
| EXAMPLE 16 | Polyacrylic acid 25% (M.W. = 49000) and Titanium isopropoxide 1% in aqueous solution at 70° C. for 1 h. | 23 |
| EXAMPLE 17 | Aminosilane 8% and Titanium isopropoxide 0.5% in aqueous solution at 70° C. for 1 h. | 65 |
| EXAMPLE 18 | 10% potassium silicate (with $K_2O:SiO_2$ molar ratio of 3.53:3.45) and 1% titanium isoproproxide in aqueous solution. | 45 |
| EXAMPLE 19 | 10% potassium silicate (with $K_2O:SiO_2$ molar ratio of 3.53:3.45) and 10% glycerol in aqueous solution. | 43 |
| EXAMPLE 20 | 10% potassium silicate (with $K_2O:SiO_2$ molar ratio of 3.53:3.45) and 0.1% sodium vanadate in aqueous solution. | 45 |
| EXAMPLE 21 | 10% potassium silicate (with $K_2O:SiO_2$ molar ratio of 3.53:3.45) and 0.1% potassium permanagate in aqueous solution. | 68 |
| EXAMPLE 22 | 1% nickel sulphate, 0.1% sodium fluoride and 2% isobutanol in aqueous solution at 35° C. | 23 |
| EXAMPLE 23 | 1% Cerium chloride, 1% hydrogen peroxide in aqueous solution at 85° C. | 65 |
| EXAMPLE 24 | 1% Magnesium sulphate, 1% Nickel sulphate and 2% sodium acetate in aqueous solution at 85° C. | 65 |

All of Examples 14 to 24 exhibited improved corrosion performance over that of the unsealed coating.

EXAMPLES 25 TO 29

The time of treatment of the metal with the rare earth ion containing cleaning solution was varied in Examples 25 and 26, as shown in Table VII. The temperature of treatment with the rare earth cleaning solution was varied in Examples 27 to 29, as shown in Table VIII. The coatings of Examples 25 to 29 are as described in Examples 1 to 4 in all other respects, with cerium concentration in the coating solution being 3.8 g/l.

TABLE VII

| | Time of Treatment with Rare Earth Cleaning Solution | | | |
|---|---|---|---|---|
| | Time | NSS (hrs) | Coating Form | Coating Time (mins) |
| EXAMPLE 25 | 1 sec. | 70 | Uniform, golden coating | 15 |
| EXAMPLE 26 | 60.0 min. | 10 | Uniform, golden coating | 5 |

Examples 25 and 26 show that for the particular conditions of these Examples, coating time for depositing coatings of similar form decreases with longer pretreatment times with the rare earth cleaning solution. However, at relatively high pretreatment times, corrosion performance decreases, suggesting that there is limited benefit in corrosion performance for cleaning times above 60 mins. This treatment time may change however, where other parameters have been varied.

TABLE VIII

| | Temperature of Treatment with Rare Earth Cleaning Solution | | | |
|---|---|---|---|---|
| | T° C. | NSS (hrs) | Coating Form | Coating Time (mins) |
| EXAMPLE 27 | Ambient | 336 | Uniform, golden coating | 5 |
| EXAMPLE 28 | 50 | 168 | Uniform, golden coating | 5 |
| EXAMPLE 29 | 85 | 10 | Pitted | 5 |

Examples 27 to 29 demonstrate that, for the specific parameters of these Examples, variation of the temperature of treatment with the rare earth cleaning solution does not substantially affect the time for depositing the rare earth coating. Moreover for rare earth cleaning at relatively high temperature, corrosion performance of the subsequently deposited rare earth coating decreases. The results suggest that, at least for the particular conditions of Examples 27 to 29, there is limited benefit in corrosion performance when exceeding a rare earth cleaning solution temperature of 85° C. However, this temperature value may change where values of the other parameters are different to those of these Examples.

EXAMPLES 30 AND 31

The following Examples compare performance of coatings preceded by cleaning of the metal with an acidic, rare earth ion containing cleaning step with those preceded by cleaning with an acidic chromate solution available under the trade name Amchem #7. The other process steps are the same as for Examples 1 to 4, with the exception that in Step 5, the silicate seal is performed at 70° C. The concentration of cerium in the coating solution was 3.8 g/l. The results are shown in Table IX.

TABLE IX

| | Cleaning Solution | NSS (hrs) | Coating Time (min) |
|---|---|---|---|
| EXAMPLE 30 | Amchem #7 | 24 | 12–15 |
| EXAMPLE 31 | Rare Earth Acidic | 114 | 4–5 |

As is evident from Table IX, the coating time required for the rare earth cleaned metal (Example 31) is approximately one third of the coating time for the chromate cleaned metal (Example 30).

Moreover, the coated, rare earth cleaned metal (Example 31) exhibited better corrosion performance than the coated, chromate cleaned metal (Example 30), in that it lasted more than four times longer in the salt spray test before pitting.

EXAMPLES 32 TO 34

The concentration of the rare earth element (in this instance, cerium) was varied in the acidic rare earth ion containing cleaning solution in the following Examples shown in Table X. In all other respects the process steps for Examples 32 to 34 are the same as for Examples 1 to 4, with cerium concentration in the coating solution at 3.8 g/l.

TABLE X

| | Concentration (g/L) of Rare Earth Element (Cerium) in Cleaning Solution of Step 3 | NSS (hrs) | Coating Time (mins) |
|---|---|---|---|
| EXAMPLE 32 | 0.014 (thin coating) | 40 | 5 |
| EXAMPLE 33 | 14 (uniform coating) | 336 | 5 |
| EXAMPLE 34 | 21 (uniform coating) | 10 | 2 |

Examples 32 and 33 suggest that for the specific conditions of those Examples, with increasing cerium concentration in the rare earth cleaning solution, there is an increase in corrosion performance in the subsequently applied rare earth conversion coating, while coating time remains substantially constant. However, Example 34 indicates that at higher cerium concentrations corrosion performance of the subsequently applied conversion coating decreases, with an attendant decrease in coating time. The results therefore suggest that, at least for the conditions of Examples 32 to 34, the maximum cost beneficial concentration of cerium in the cleaning solution is likely to be between 14 and 21 grams/liter. However, this value may change under different values of other parameters.

EXAMPLES 35 TO 37

Table XI shows the effect on coating time and corrosion performance of the concentration of $H_2SO_4$ in the acidic, rare earth cleaning solution. In all other respects, the process steps of Examples 35 to 37 are the same as for Examples 1 to 4, with cerium concentration in the coating solution being 3.8 g/l.

TABLE XI

| | Concentration of $H_2SO_4$ (molar) | NSS (hrs) | Coating Time (mins) |
|---|---|---|---|
| EXAMPLE 35 | 1.7 (uniform thin coating) | 80 | 5 |
| EXAMPLE 36 | 2 (uniform thin coating) | 336 | 5 |
| EXAMPLE 37 | 2.75 (uniform thin coating) | 50 | 5 |

Examples 35 and 36 show that, for the specific conditions of these Examples, corrosion performance of the subsequently coated metal improves at higher $H_2SO_4$ concentration. Without wishing to be limited to a particular mechanism, this feature is probably because at higher acid concentration more cerium can be dissolved in solution thereby resulting in a more effective cleaning solution. Conversely, Examples 36 and 37 show that at still higher $H_2So_4$ concentration, corrosion performance decreases again. Again without wishing to be limited to a particular mechanism this observation may be explained by higher acid attack of the metal surface. The Examples suggest that, for the specific conditions of Examples 35 to 37, the maximum cost beneficial concentration of $H_2SO_4$ in the cleaning solution is likely to be between 2 and 2.75 molar. However, clearly $H_2SO_4$ concentration may exceed 2.75 molar in some application and still result in acceptable corrosion performance. Moreover, the maximum cost effective concentration of $H2SO_4$ may vary according to the particular values of other parameters.

EXAMPLES 38 AND 39

In addition to the $H_2SO_4$, $HNO_3$ may optionally be added to the acidic rare earth cleaning solution. Table XII shows two concentration values of $HNO_3$. In all other respects, the process steps are the same as for Examples 1 to 4, with cerium concentration in the coating solution at 3.8 g/l.

TABLE XII

| | Concentration (g/L) of $HNO_3$ | NSS (hrs) | Coating Time (mins) |
|---|---|---|---|
| EXAMPLE 38 | 10 (uniform thin coating) | 50 | 5 |
| EXAMPLE 39 | 50 (uniform thin coating) | 10 | 5 |

Examples 38 and 39 indicate that, for the specific conditions of these Examples, at relatively low $HNO_3$ concentration, acceptable corrosion performance of the subsequently coated metal results. However, at higher $HNO_3$ concentration, the corrosion performance decreases. However, $HNO_3$ concentration may vary in response to different values for other parameters. It is noted that coating times for these Examples are substantially constant.

In Examples 40 to 57, reference is made to a "Standard" rare earth containing cleaning solution which has 0.05 molar Ce ions, added in the form of ammonium cerric sulphate, and 0.5 molar $H_2SO_4$.

EXAMPLES 40 to 47

Table XIII shows the effect of the additives $F^-$, $PO_4^{3-}$, $HNO_3$ and $TiCl_4$ to the standard rare earth containing cleaning solution, and temperature of cleaning solution, on the subsequent time required to produce a golden coating on the surface of a 6061 aluminium alloy when treated with the rare earth containing coating solution.

All of Examples 40 to 47 were immersed in the cleaning solution for ten minutes.

TABLE XIII

| Example | Composition of Cleaning Solution | Temp (° C.) of Cleaning Solution | Coating Time (min) |
|---|---|---|---|
| 40 | Standard | 21 | 15 |
| 41 | Standard | 35 | 10 |
| 42 | Standard + 0.015M $F^-$ | 35 | 10 |
| 43 | Standard + 0.15M $F^-$ | 21 | 10 |
| 44 | Standard + 0.15M $F^-$ | 35 | 10 |
| 45 | Standard + 0.05N $F^-$ + 0.015M $PO^{3-}$ | 35 | 5 |
| 46 | Standard + 0.05M $F^-$ + 0.05M $HNO_3$ | 35 | 2 |
| 47 | Standard + 145 ppm Ti (as $TiCl_4$) | 35 | 5 |

Examples 40 and 41 demonstrate that, at least for the particular conditions of those Examples, an increase in the temperature of the cleaning solution results in a reduction in coating time for the subsequently applied conversion coating. Comparison of Examples 41, 42 and 44 indicate that for a cleaning solution temperature of 35° C., addition of $F^-$ ions to the cleaning solution has no apparent effect on the subsequent coating time. However, Examples 40 and 43 show that, for a cleaning solution at a temperature of 21° C., addition of $F^-$ to give a concentration of 0.15M$F^-$ results in a decrease in subsequent coating time from 15 minutes to 10 minutes.

Examples 45 to 47, when compared with Example 41 show that addition of $F^-$ in combination with $PO_4^{3-}$ or $HNO_3$ to the cleaning solution at a temperature of 35° C. results in a decrease in subsequent coating time. Of the three Examples, Example 46 relating to a coating solution containing $F^-$ and HNO exhibits the shortest coating time of only 2 minutes.

EXAMPLES 48 TO 55

TABLE XIV

| Example | Composition of Cleaning Solution | Temp (° C.) of Cleaning Solution | Coating Time (min) |
|---|---|---|---|
| 48 | Standard | 21 | 15 |
| 49 | Standard + 0.0015M $F^-$ | 21 | 10 |
| 50 | Standard + 0.15M $F^-$ + 0.01M $H_3PO_4$ | 21 | 10 |
| 51 | Standard + 145 ppm Ti (as $TiCl_4$) | 21 | 10 |
| 52 | Standard | 35 | 15 |
| 53 | Standard + 0.0015M $F^-$ | 35 | 10 |
| 54 | Standard + 0.15M $F^-$ + 0.01M $H_3PO_4$ | 35 | 5 |
| 55 | Standard + 145 ppm Ti (as $TiCl_4$) | 35 | 5 |

Examples 48 to 55 also demonstrate the effect on coating time of additives to and temperature of the rare earth element containing cleaning solution. (see Table XIV). All of Examples 48 to 55 were 6061 aluminium alloys and were immersed in the cleaning solution for 5 minutes.

Comparison of Example 48 with Example 40 indicates that, for the particular conditions of those Examples, an increase in the time of immersion in the cleaning solution of 5 minutes, at a cleaning solution temperature of 21° C., does not affect the subsequent coating time. However, comparison of Examples 52 and 41 do show a 5 minute decrease in subsequent coating time, when the immersion time is increased by 5 minutes at a temperature of the cleaning solution of 35° C.

Comparison of Example 48 with Examples 49 to 51 illustrate the reduction in coating time with the addition of $F^-$, either alone or in combination with $H_3PO_4$, or with the addition of $TiCl_4$. The same trend is true also for Examples 52 to 55 which are representative of a cleaning solution temperature of 35° C. At a concentration of 0.0015M $F^-$, the subsequent coating time is reduced to 10 minutes. At a concentration of 145 ppm Ti, or 0.15M $F^-$ in combination with 0.01M $H_3PO_4$, the coating time is just 5 minutes. Moreover, comparison of Example 49 with Example 53 shows that for the particular conditions of those Examples, an increase in temperature from 21° C. to 35° C. of the cleaning solution containing fluoride ions does not affect coating time. However comparison of Examples 54 with 50 and Examples 55 with 51 does show a decrease in coating time with an increase in temperature from 21° C. to 35° C., for the particular conditions of those Examples.

Comparison of Example 52 with Example 41 suggests that at 35° C., the coating time decreases with a longer immersion time in the cleaning solution. By increasing the immersion time from 5 minutes to 10 minutes, the time to deposit the subsequent rare earth conversion coating is lessened by five minutes.

However, Examples 48 and 40 demonstrate that there is no significant change in coating time if immersion time in the cleaning solution is increased from 5 minutes to 10 minutes.

EXAMPLES 56 AND 57

TABLE XV

| Example | Composition of Cleaning Solution | Temp (° C.) of Cleaning Solution | Coating Time (min) |
|---|---|---|---|
| 56 | Standard | 35 | 5 |
| 57 | Standard + 0.15M F + 0.01M $H_3PO_4$ | 35 | 2 |

Table XV lists coating times for 2024 alloy cleaned with a standard rare earth element containing cleaning solution (Example 56) and the standard cleaning solution with 0.15M $F^-$ and 0.01M $H_3PO_4$ (Example 57). For both Examples 56 and 57, the temperature of the cleaning solution is 35° C. and immersion time is 5 minutes. For at least the particular conditions of these Examples, the addition of $F^-$ and $H_3PO_4$ results in a decrease in the subsequent coating time.

In general, the use of the acidic, rare earth ion containing cleaning solution according to the invention, as represented by the Examples, resulted in removal of smut from the metal surface, as evidenced by visible brightening of the metal. In addition, the rare earth ion containing cleaning solution was found to substantially reduce coating time of the subsequently deposited conversion coating, as compared to coating times for metal surfaces pretreated with a chromate based cleaning solution, by up to two thirds.

While the above Examples concentrate on cerium based cleaning solutions, in general solutions based on other suitable rare earth elements perform similarly to those based on cerium, but with varying degrees of effectiveness.

One such other rare earth element is praseodymium. An acidic, rare earth ion containing cleaning solution was prepared by dissolving praseodymium oxide in sulphuric acid to give a cleaning solution containing 0.02 molar $Pr_2(SO_4)_3$ and 0.7 molar $H_2SO_4$.

Of all the rare earths, cerium-based rare earth ion containing cleaning solutions are most preferred as they are less expensive and more chemically stable than cleaning solutions based on other rare earth elements.

Finally, it is to be understood that various alterations, modifications and/or additions may be introduced into the constructions and arrangements of parts and/or steps previously described without departing from the ambit of the invention. It should be also understood that the foregoing description of the invention is not intended to be limiting, but is only exemplary of the inventive features which are defined in the claims.

What is claimed is:

1. A process for treating a surface of a metal selected from the group consisting of aluminum, steel, zinc, cadmium, magnesium and their alloys, to remove contaminants and to remove smut from the surface, comprising the steps of:

(a) contacting the metal surface having contaminants thereon with an alkaline cleaning solution to remove the contaminants, said alkaline solution causing the formation of smut on the metal surface; and (b) treating the alkaline treated metal surface by contact with a sufficient amount of an acidic, rare earth ion desmutting solution, having a pH of less than 1, for a sufficient time to remove smut formed on said metal surface by the treatment with said alkaline cleaning solution of step (a), without formation of a rare earth metal—containing coating on the cleaned metal surface wherein the smut removal is effected by reaction of the rare earth ions and the acid with the smut on the metal surface.

2. The process of claim 1, wherein the metal is an aluminum alloy.

3. The process of claim 2, wherein said aluminum alloy is selected from the group consisting of: 2024, 6061 and 7075 alloys.

4. The process of claim 1, wherein said desmutting solution of step (b) comprises one or more mineral acids.

5. The process of claim 1, wherein said desmutting solution of step (b) has a pH of less than 0.5.

6. The process of claim 1, wherein said rare earth ion is a cerium ion and/or a mixture of rare earth ions.

7. The process of claim 1, wherein the concentration of said rare earth ion in said desmutting solution of step (b) is up to 1 mole/liter.

8. The process of claim 1, wherein the concentration of said rare earth ion in said desmutting solution of step (b) is at least 0.005 mole/liter.

9. The process of claim 1, wherein step (b) is performed using the desmutting solution at a temperature of 50° C. or lower.

10. The process of claim 1, wherein the metal surface is treated with said desmutting solution of step (b) for up to one hour.

11. The process of claim 1, wherein the desmutting solution of step (b) further comprises an effective amount of an etch rate accelerator.

12. The process of claim 11, wherein said etch rate accelerator comprises fluoride ions added as $NH_4F.HF$ and having a concentration up to 0.15 molar.

13. The process of claim 11, wherein said etch rate accelerator comprises fluoride ions, added as $NH_4F.HF$ and/or KF.HF and having a concentration of 0.05 molar, and nitric acid having a concentration of 1.28 molar.

14. The process of claim 11, wherein said etch rate accelerator comprises phosphate ions added as $H_3PO_4$ and having a concentration of up to 0.02 molar.

15. The process of claim 1, wherein said desmutting solution of step (b) further comprises an oxidizing agent.

16. The process of claim 1, wherein said rare earth ion containing desmutting solution further comprises an oxidizing agent.

17. The process of claim 1, wherein steps (a) and (b) are performed sequentially and are followed by the further step:

(c) coating the treated metal surface by contacting with an aqueous, acidic, rare earth ion containing coating solution different from the desmutting solution of step (b), said coating solution having a pH greater than 1 and including rare earth cations which have at least one valence state above zero valency, whereby during contact of the metal surface with said coating solutions the pH of the coating solution is increased to a value at which one or more compounds of the rare earth element are precipitated, thereby to cause the compound of the rare earth element to precipitate in a coating on the metal surface.

18. A process for treating a surface of a metal selected from the group consisting of aluminum, steel, zinc, cadmium, magnesium and their alloys, to remove contaminants and to remove smut from the surface, comprising the steps of:

(a) contacting the metal surface having contaminants thereon with an alkaline cleaning solution to remove said contaminants, said alkaline solution causing the formation of smut on the metal surface; and (b) treating the alkaline treated metal surface by contact with a sufficient amount of an acidic, rare earth ion containing desmuttinq solution, having a pH of less than 1, for a sufficient time to remove smut formed on said metal surface by the treatment with said alkaline cleaning solution of step (a), without formation of a rare earth metal—containing coating on the cleaned metal surface wherein the smut removal is effected by reaction of the rare earth ions and the acid with the smut on the metal surface;

wherein the desmuttina solution of step (b) further comprises an effective amount of an etch rate accelerator; and wherein said etch rate accelerator comprises titanium ions added as $TiCl_4$ and having a concentration of up to 1000 ppm.

19. An aqueous acidic solution of a desmutting composition, said desmutting composition consisting essentially of one or more rare earth containing compounds, wherein the ions of the one or more rare earth elements are present in said solution in an amount effective to remove smut from a metal surface previously contacted with an alkaline cleaning solution, said solution having a pH of less than 1.0.

20. The solution of claim 19, wherein the mineral acid is sulfuric acid.

21. The solution of claim 19, which has a pH of less than about 0.5.

22. The solution of claim 19, wherein the rare earth ion is cerium and/or a mixture of rare earth ions.

23. The solution of claim 19, wherein the concentration of rare earth ions in said desmutting solution is up to 0.15 mole/liter.

24. The solution of claim 19, further comprising an etch rate accelerator.

25. The solution of claim 24, further comprising an etch rate accelerator, wherein said etch rate accelerator includes fluoride ions added as $NH_4F.HF$ and having a concentration up to 0.15 molar.

26. The solution of claim 19, further including an etch rate accelerator, wherein said etch rate accelerator includes fluoride ions, added as $NH_4F.HF$ and having a concentration of 0.05 molar, and nitric acid having a concentration of 1.28 molar.

27. The solution of claim 19, further including an etch rate accelerator, wherein said etch rate accelerator comprises phosphate ions added as $H_3PO_4$ and having a concentration of up to 0.02 molar.

28. An acidic rare earth containing aqueous desmutting solution, which comprises one or more compounds of one or more rare earth elements dissolved in a solution containing one or more mineral acids, and wherein ions of the one or more rare earth elements are present in solution in an amount effective to remove smut from a metal surface previously contacted with an alkaline cleaning solution, said solution having a pH of less than 1.0.

29. The solution of claim 28, which comprises one or more compounds of one or more rare earth elements dissolved in a solution containing one or more mineral acids, wherein the total concentration of the mineral acid is up to 5 molar.

30. An acidic, rare earth containing aqueous desmutting solution, said solution consisting essentially of:

one or more rare earth containing compounds dissolved in an aqueous acidic solution, wherein the ions of the one or more rare earth elements are present in solution in an amount effective to remove smut from a metal surface previously contacted with an alkaline cleaning solution, said solution having a pH of less than 1.0; and an etch rate accelerator, said etch rate accelerator including titanium ions added as $TiCl_4$ and having a concentration up to 1000 ppm.

31. An acidic, chromium-free, rare earth ion containing aqueous desmutting solution, said solution including ions of one or more rare earth elements in an amount effective to remove smut from a metal surface previously contacted with an alkaline cleaning solution, said solution being essentially free of chromium, said solution having a pH of less than about 0.5.

32. The solution of claim 31, further comprising an oxidizing agent.

33. The solution of claim 32, wherein said oxidizing agent is a peroxide or a persulphate.

34. An acidic, rare earth ion containing aqueous desmutting solution consisting essentially of $(NH_4)_2Ce(IV)(SO_4)_3$ dissolved in a 0.5 molar $H_2SO_4$ solution, wherein the concentration of cerium ions in said solution is 0.05 molar and the solution pH is less than 1.0.

35. An acidic, rare earth ion containing aqueous desmutting solution consisting essentially of $(NH_4)_2Ce(IV)(SO_4)_3$ and one of KF.HF and $NH_4F.HF$ dissolved in a mineral acid solution comprising 0.5 molar $H_2SO_4$ and 1.28 molar $HNO_3$, said desmutting solution having 0.05 molar cerium ions and 0.05 molar fluoride ions and a pH of less than 1.0.

36. An acidic, aqueous, desmutting solution, said desmutting solution comprising desmutting ions of one or more rare earth elements in an amount effective to remove smut from a metal surface previously contacted with an alkaline cleaning solution, said solution further including at least one etch rate accelerator selected from the group consisting of halide ions, phosphate ions, nitrate ions and titanium ions, and having a pH of less than 1.0.

37. The solution of claim 36, further comprising an oxidizing agent.

38. A process for treating a surface of a metal selected from the group consisting of aluminum, steel, zinc, cadmium, magnesium and their alloys, to remove contaminants and to remove smut from the surface, comprising the steps of:

(a) contacting the metal surface having contaminants thereon with an alkaline cleaning solution to remove said contaminants, said alkaline solution causing the formation of smut on the metal surface; and (b) treating the alkaline treated metal surface by contact with a sufficient amount of an acidic, rare earth ion containing desmuttina solution, having a pH of less than 1, for a sufficient time to remove smut formed on said metal surface by the treatment with said alkaline cleaning solution of step (a), without formation of a rare earth metal—containing coating on the cleaned metal surface wherein the smut removal is effected by reaction of the rare earth ions and the acid with the smut on the metal surface;

wherein said rare earth ion containing desmutting solution further comprises an oxidizing agent; and wherein said oxidizing agent is a peroxide or a persulphate.

* * * * *